US006250913B1

(12) United States Patent
Maton

(10) Patent No.: US 6,250,913 B1
(45) Date of Patent: Jun. 26, 2001

(54) BURNER

(75) Inventor: Maurice Edward George Maton, Ashurst (GB)

(73) Assignee: Graveson Energy Management Ltd. (GB)

( * ) Notice: Subject to any disclaimer, the term of this patent is extended or adjusted under 35 U.S.C. 154(b) by 0 days.

(21) Appl. No.: 09/485,502

(22) PCT Filed: Jun. 16, 1999

(86) PCT No.: PCT/GB99/01919

§ 371 Date: Mar. 15, 2000

§ 102(e) Date: Mar. 15, 2000

(87) PCT Pub. No.: WO99/66263

PCT Pub. Date: Dec. 23, 1999

(30) Foreign Application Priority Data

Jun. 16, 1998 (GB) ..... 9812975

(51) Int. Cl.[7] ..... F23D 14/62

(52) U.S. Cl. ..... 431/354; 431/353; 431/346; 431/76; 431/264

(58) Field of Search ..... 431/265, 264, 431/266, 354, 353, 350, 75, 76, 77, 24, 25, 346, 181, 326, 328; 239/601

(56) References Cited

U.S. PATENT DOCUMENTS

| | | | | |
|---|---|---|---|---|
| 3,635,644 | * | 1/1972 | Reid, Jr. | 431/328 |
| 3,957,421 | * | 5/1976 | Wikman | 431/353 |
| 4,224,019 | * | 9/1980 | Dilmore | 431/354 |
| 4,752,213 | * | 6/1988 | Grochowski et al. | 431/328 |
| 4,875,850 | * | 10/1989 | Cagnon et al. | 431/354 |
| 5,447,427 | * | 9/1995 | Susuki | 431/350 |
| 5,547,372 | * | 8/1996 | Smith | 431/328 |

FOREIGN PATENT DOCUMENTS

| | | | |
|---|---|---|---|
| 32 30 853 | * | 2/1984 | (DE) . |
| 0 269 487 | | 10/1987 | (EP) . |
| 2 398 966 | | 2/1979 | (FR) . |
| 2 290 608 | | 1/1996 | (GB) . |
| 9100767 | | 12/1992 | (NL) . |
| 1004647 | | 6/1998 | (NL) . |
| 0002289 | | 8/1927 | (RU) . |
| 2138733 | | 9/1999 | (RU) . |

* cited by examiner

*Primary Examiner*—Ira S. Lazarus
*Assistant Examiner*—Josiah C. Cocks
(74) *Attorney, Agent, or Firm*—Nields & Lemack

(57) ABSTRACT

A burner for combusting gaseous mixture of gaseous fuel with a combustion supporting gas, such as oxygen or air, comprising a burner tube (11) open at one end (11') and closed at its other end (11") with a flame holder (30) at which fuel is burnt adjacent the open end (11'), the flame holder (30) being traversed by passageways (52, 54, 56, 58) for the gaseous mixture, the burner (10) having inlets (14, 16) adjacent the closed end (11") connected to combustion supporting gas and gaseous fuel supply lines, one of said lines having a control valve operable for controlling the size of the flame, the said one line having a pressure or flow transducer and the other line having a variable booster or restricter responsive to the transducer, for balancing air and fuel supplied to the burner (10) to ensure the gaseous mixture remains stoichiometric irrespective of the size of the flame and such that the lowest gaseous fuel mixture flow rate is at least as low as 1/60th the highest flow rate of the gaseous fuel mixture each passageway (52, 54, 56, 58) having a flared exit (60) at the end nearer the open end (11') of the burner (11) each passageway being dimensioned such that at the highest obtainable flow rate of gaseous fuel mixture the flames do not lift off from the flamer holder, at the lowest flow rate the velocity of the gaseous fuel mixture at some point within the passageway (52, 54, 56, 58) is sufficient to prevent flame back though the flame holder.

14 Claims, 3 Drawing Sheets

BURNER

The present invention relates to a gas burner suitable for use in incinerators, boilers, space heating appliances and ovens, furnaces or high temperature reactors used in industry, for example. A burner incorporating the flame holder is also highly suitable for use in a flare stack.

The gas to be used as fuel can be any of the combustible gases commonly used in gas burners. For example, the gas can be butane, propane, natural gas and hydrocarbon product gases produced by gasification of organic materials, such as commercial or general domestic waste.

The burner disclosed hereinafter has been devised to secure complete mixing of the fuel and air or oxygen, and to admit them to a mixing chamber in the burner only in the correct stoichiometric ratio required by the fuel for its complete combustion whilst providing a stable flame over a turn-down ratio of up to 60:1, at least.

A preferred burner for combusting gaseous fuel, comprises a burner tube open at one end and closed at its other end with a flame holder at which fuel is burnt adjacent the open end, the flame holder being traversed by passages for fuel and air to be consumed, the burner having inlets adjacent the closed end respectively for air, or oxygen, and fuel, the inlets being furnished with metering nozzles for separately delivering air and fuel substantially radially into the tube which forms a mixing zone between the inlets and the flame holder, the metering nozzles having orifices with flow cross-sectional areas correlating to the stoichiometric ratio of air-to-fuel for which the fuel is substantially completely burnt.

A burner of the present invention beneficially tolerates widely-varying air/fuel flow rates, i.e. it has a high turn-down ratio. Conventional burners have turn-down ratios of the order of 4 or 5 to 1. Thus, the supply rates of air and fuel can be reduced to one quarter or one fifth of the maximum capacity of such burners. Further reduction results in flame instability; ultimately the flame fails and is extinguished.

The present invention seeks to provide a burner with a much larger turn down ratio. Accordingly, it provides a burner for combusting gaseous mixture of gaseous fuel with a combustion supporting gas, such as oxygen or air, comprising a burner tube open at one end and closed at its other end with a flame holder at which fuel is burnt adjacent the open end, the flame holder being traversed by passageways for the gaseous mixture, the burner having inlets adjacent the closed end connected to combustion supporting gas and gaseous fuel supply lines, one of said lines having a control valve operable for controlling the size of the flame, the said one line having a pressure or flow transducer and the other line having a variable booster or restricter responsive to the transducer, for balancing air and fuel supplied to the burner to ensure the gaseous mixture remains stoichiometric irrespective of the size of the flame and such that the lowest gaseous fuel mixture flow rate is at least as low as $1/60^{th}$ the highest flow rate of the gaseous fuel mixture each passageway having a flared exit at the end nearer the open end of the burner each passageway being dimensioned such that at the highest obtainable flow rate of gaseous fuel mixture the flames do not lift off from the flamer holder, at the lowest flow rate the velocity of the gaseous fuel mixture at some point within the passageway is sufficient to prevent flame back through the flame holder.

The burner of the present invention represents a marked departure from prior art burners in that the burner can provide a stable flame at the flame holder at low flow rates yet can provide a 60 fold increase in gaseous mixture flow rate by providing sources of gaseous fuel and combustion supporting gas which can provide sufficiently high pressures to provide, at the high flow rate, a sufficient pressure drop over the flame holder passageways to obtain the required flow rate.

The burner of the present invention holder of the can provide a turn-down ratio of the order of 60:1, and thus a stable flame is retained even when the supply of air and fuel is reduced to one sixtieth of the maximum capacity.

Such a high turn-down ratio is highly advantageous, since heat output can be controlled over a wide range. Moreover, such a burner is ideal for use in situations where the gas supply is variable, such as may occur in the case of flare stacks.

The inlets may be furnished with metering nozzles for separately delivering air and fuel non-axially, e.g. substantially radially into the tube which forms a mixing zone between the inlets and the flame holder the metering nozzles having orifices with flow cross-sectional areas correlating to the stoichiometric ratio of air-to-fuel for which the fuel is substantially completely burnt. Preferably the inlets are disposed in the tube for delivering air and fuel in directions which impinge, to create turbulence and mixing inside the tube, for example by locating the inlets diametrically opposite one another in the tube.

Conveniently, the flame holder provides a mounting for an igniter and associated ground electrode, and, optionally, further provides a mounting for an ionization probe.

Preferably the burner includes a monitor and control system coupled to the probe, for interrupting the fuel supply should the unburnt carbon exceed a predetermined level.

In such an embodiment, there may be a valve in the air supply line and a booster or restricter in the fuel line, or there may be a valve in the fuel line and a variable speed fan provided in the air line.

The flame holder may comprise two or more radially nested tubes each pair of adjacent tubes defining therebetween one of said passageways of the flame holder for the gaseous fuel, but other ways of defining the passageways may be employed, for example, a plurality of holes in a disc.

The tubes (30*a*, 30*b*, 30*c*) may be held in position relative to each other by one or more transverse pins (33) and include a central bore with a flared exit.

Each flared exit may have its terminal portion defined by inner and outer cylindrical walls which are parallel to the longitudinal axis of the flame holder.

A burner of the present invention will now be described, by way of example only, with reference to the accompanying drawings, in which.

Figure 1:
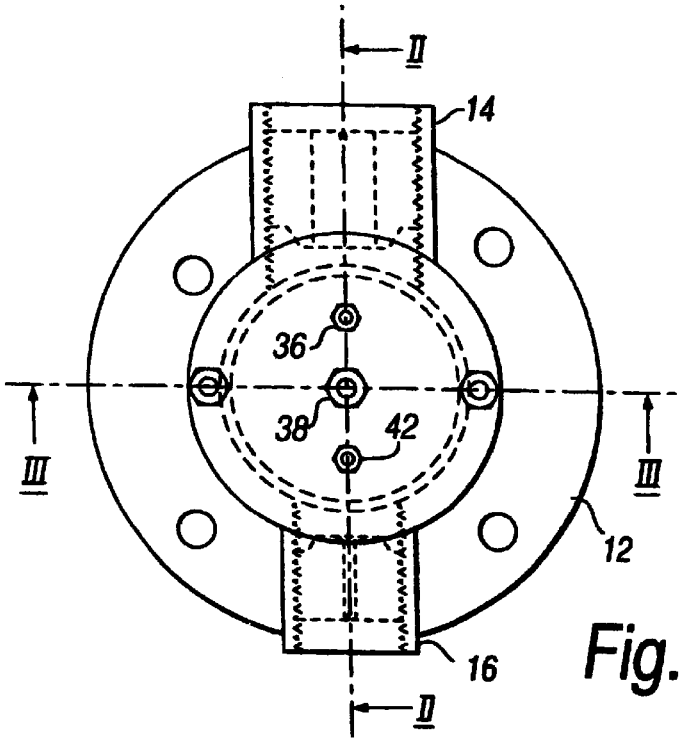
FIG. 1 is an end view of the burner incorporating an embodiment of flame holder according to the present invention.
Figure 2:
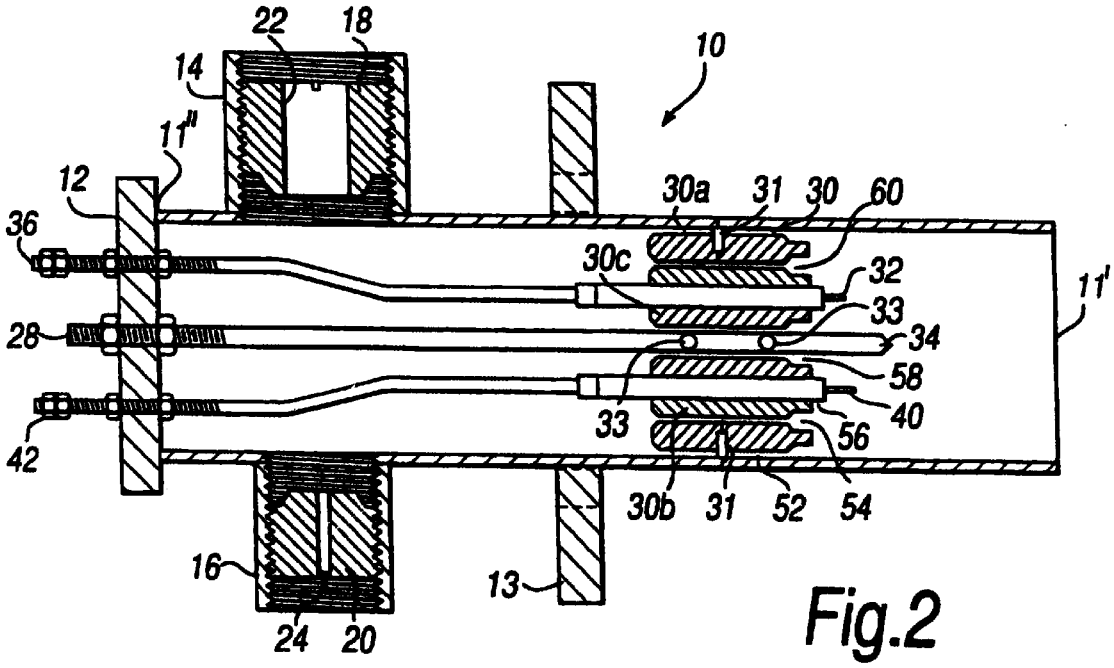
FIG. 2 is a longitudinal cross-section through the burner of FIG. 1, on line II—II of FIG. 1.

The burner 10 illustrated in the drawings comprises a tubular case 11 of heat resistant material such as stainless steel, and is provided with a mounting flange 13 for securing it in a combustor apparatus, not shown. The combustor apparatus could be a boiler, a gas-fired space heating appliance, a furnace, or a flare stack, for example.

A forward end 11' of the burner is open, for the flame to issue therefrom, and the opposite, rearward end 11" is closed by and sealed to an acrylic viewing window 12.

Adjacent the rearward end, there are inlets 14, 16 for air (or oxygen) and for fuel, i.e. combustible gas. The inlets 14, 16 are internally screw-threaded to receive unions for coupling them to appropriate air/fuel supply lines.

The fuel inlet 16 is smaller than the air inlet 14. Both inlets 14, 16 are internally screw-threaded and inside each is a metering nozzle 18, 20. Metering nozzle 18 has a bore 22 which is of substantially greater diameter than bore 24 of metering nozzle 20.

The flow cross-sectional areas of the bores 22, 24 are in a ratio corresponding to the stoichiometric ratio of fuel-to-air, at which the combustible fuel is completely oxidized, i.e. burned. For complete combustion, different fuels require different amounts of air (or oxygen), and hence the stoichiometric ratios will vary from one fuel to another.

It is contemplated, therefore, that the nozzles 18 and 20 will be matched to the stoichiometry requirements of the particular fuel to be combusted. Thus, one or both nozzles 18, 20 will be changed to suit the fuel, whenever the fuel to be combusted is changed, to maximise combustion efficiency, the gases being supplied to the nozzles 18 and 20 at the same pressure so the flow of fuel and air is proportional to the bores of 22, 24 of the nozzles 18, 20 and which equal pressure condition will be assumed for the remaining description.

The required ratio of the flow cross-sectional areas of bores 22, 24 can be determined empirically. Alternatively, it can be established theoretically if the composition of the fuel is known.

By way of example, the ratio of the areas of bores 22, 24 is of the order of 10:1 for fuels comprising hydrocarbon gas mixtures, at air and gas pressures of the order of 30" water gauge (76 mbar). By way of comparison, existing high pressure burners may operate at 2–3" water gauge (5.1–7.6 mbar). Standard commercial burners are usually run at 0.5" water gauge (1.3 mbar) air pressure and 2" water gauge (5.1 mbar) gas pressure.

Inside the burner case 11 there is a fixed flame holder 30 according to the present invention fabricated from nested coaxial steel rings. The flame holder 30 defines basically annular jets from which streams of mixed fuel and air issue. The jets are ignited to establish the required flame. To ignite the jets, a spark igniter is provided. The igniter comprises a spark electrode 32 and a ground electrode 34. The electrode 32 is electrically insulated from the flame holder 30. The electrodes 32 and 34 extend rearwardly to and through the window 12 to respective terminals 36, 38 for connection to an electrical supply.

The flame holder 30 is made up of three coaxial tubes 30*a*, 30*b*, 30*c* held in a fixed spatial relationship by axially spaced, transverse brass pins 33 (see FIG. 3) which have been push fit in aligned diametric holes through the tubes 30*a*, 30*b*, 30*c*. The flame holder 30, as a unit, is supported and located within the burner case 11 by pins 31.

The tubes 30*a*, 30*b*, 30*c* are dimensioned and configured to provide relatively narrow annular passageways 52, 54, 56 and 58 between the tube 30*a* and the burner case 11 between tubes 30*a* and 30*b*, between tubes 30*b* and 30*c* and between tube 30*c* and electrode 30. All these passageways have flared exits 60 at the end of the flame holder 30 nearer the open end 11' of the burner tube 11.

Three tubes are present in the illustrated embodiment but the number selected, from one upwards, is determined by the maximum power output required from the burner 10.

Figure 3:
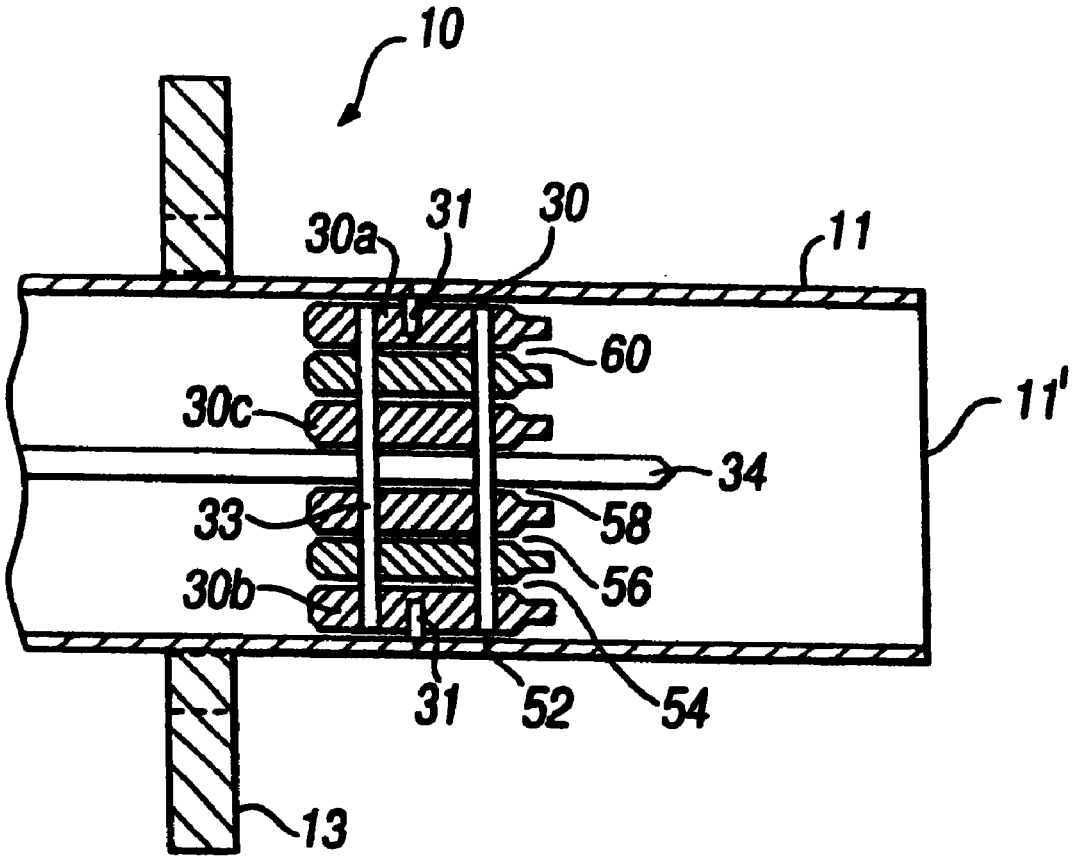
FIG. 3 is a longitudinal cross-section of the flame holder end of the burner of FIG. 1 on line III—III of FIG. 1.

Each of the tubes 30*b* and 30*c* has a pair of longitudinal half-cylindrical grooves which co-operate to provide two generally cylindrical passages for insertion and retention of the electrode 32 and probe 40, as shown in FIG. 1, the remainder of the annular passage between tubes 30*b* and 30*c* being as provided between tubes 30*a* and 30*b* as can be seen in FIG. 3.

The passageways and flared exits are dimensioned such that at the maximum designed flow rate of combustible mixture the flame is retained at the flame holder and such that at the lowest designed flow rate of combusible mixture the velocity of the combustible mixture within the narrow portions of the passageways 52 to 58 is sufficient to prevent "flame back", ie back propagation of the flame to the mixing chamber.

Also mounted insulatingly in the flame holder 30 is an ionization probe 40 which again extends rearwardly through plate 12 to a terminal 42. Using ionization probe 40 and the ground electrode 38, the carbon content of the flame can be monitored. If the carbon content is found to be lower than a predetermined level, indicating inadequate combustion, the monitor can be arranged in known manner to trigger a control system to interrupt the fuel supply. Thus, the flame can be extinguished.

In conventional blown gas burners, the gaseous fuel is ejected from a nozzle at the end of the burner tube, and the flame is ignited at that point. The gas is conveyed to the nozzle by an axially-disposed conduit inside the tube. The air required for combustion is supplied, by a powered air fan through ports in the tube, close upstream of the nozzle. The air mixes with the gas exiting the nozzle at the point of ignition.

For combustion to take place fully and stoichiometrically, air and gas must be mixed together in the correct volumetric proportions. Where one gas is injected into the other, as in a conventional blown burner, combustion is not always at its most efficient, since mixing is occurring while combustion is taking place. As a result, mixing of air and fuel is incomplete. It is virtually impossible to attain the correct air/fuel stoichiometry across the flame front. Thus, the flame is observed to possess distinct, differently coloured flame zones, indicative of poor mixing, varying fuel/air stoichiometry and imperfect fuel combustion.

In contrast, with a burner according to this invention, the flame emanating from the flame holder 30 is observed to be substantially uniform across the entire flame front, uniformly bright blue and with very little yellow flame regions being evident. A flame of this appearance is a practical realisation of an ideal flame wherein the fuel is virtually completely combusted.

The complete combustion attainable by burner 10 is believed to be the result of two features of the burner. First, the fuel and air are introduced in the correct stoichiometric ratio governed primarily by the sizes of the bores 22, 24 of the nozzles 18, 20. Second, it will be seen from the drawing that the bores of nozzles 18, 20 introduce the air and fuel to the burner casing as counter flowing jets, i.e. the two jets impinge on one another. As shown, the nozzles provide diametrically-opposed jets. Such impinging jets ensure very effective initial mixing in the burner casing. Basically, highly turbulent flows are created in the rearward end of the casing 11, which provides a mixing chamber of significant length between the nozzles 18, 20 and the outlet end of the flame holder 30. By the time fuel/air introduced by nozzles 18, 20 reach the flame holder 30, they are in a completely mixed condition ideal for correct and complete combustion.

The operation and output of the burner 10 can be controlled in various ways. Desirably, the air supply will include a control valve and the air supply line will incorporate a flow or pressure transducer. This, in turn, will control a fuel balancer, i.e. a gas booster or restricter. Such equipment will be known to the addressee and hence is not described in detail here. Suffice to say, however, the objective of the control system is to balance the gas and air pressures and flows to the burner 10, to maintain the desired stoichiometry when turning down the burner using the air control valve. With such an arrangement, the only valve to be operated is the air control valve.

Figure 4:
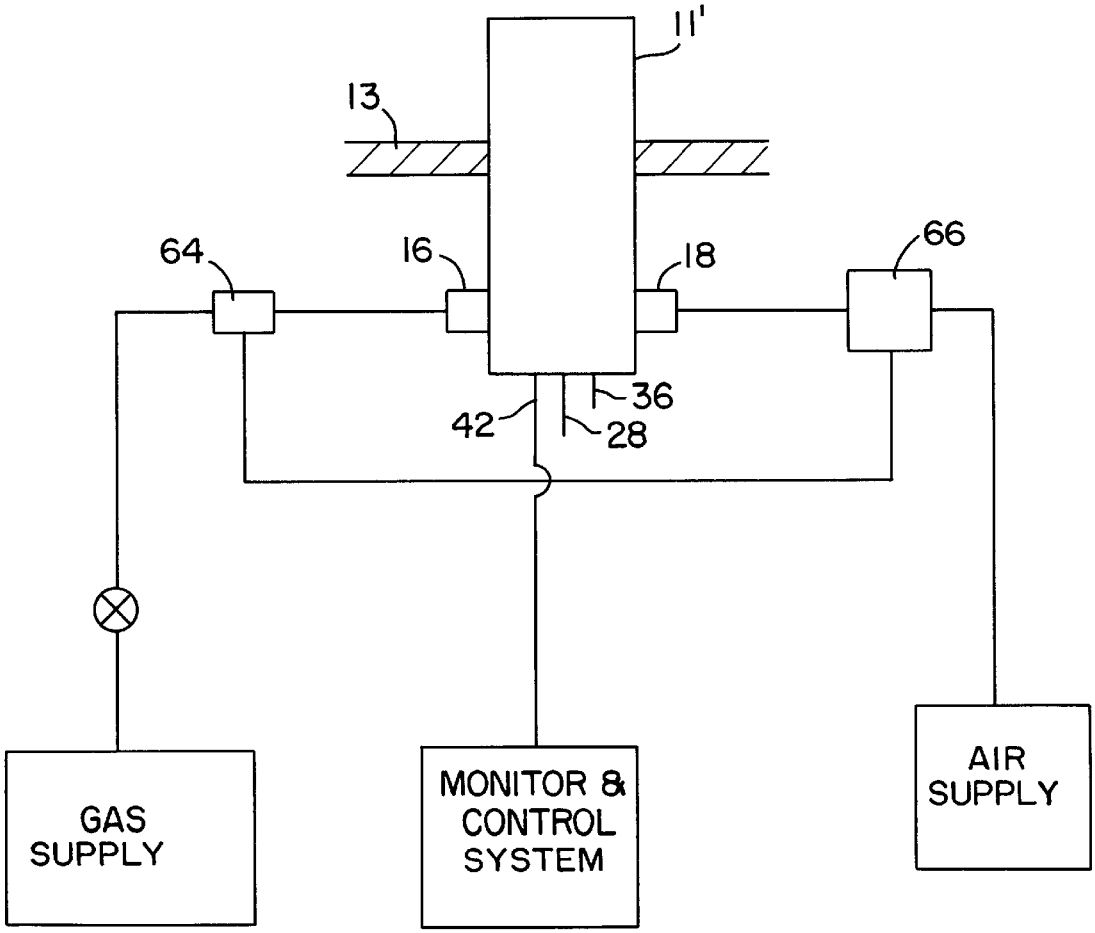
FIG. 4 is a schematic diagram of the burner of FIG. 1 in circuit with flame size control apparatus.

Alternatively, referring now to FIG. 4, the burner could be controlled by a single valve (62) operating in the gas supply line instead. In this case, the gas pressure or flow is determined by a transducer (64) which is used to control the air pressure or flow. By way of example, the air pressure or flow can be varied using a suitable variable speed fan or blower (66).

In installations utilising more than one burner, e.g. in a boilerhouse, it is contemplated that air and fuel gas will both be supplied at high pressure. Then, only balancer devices would be required to ensure all the burners receive air and fuel in the correct volumetric ratios.

The burner 10 as described could be employed alone in a small appliance, e.g. a domestic or small commercial space heating system, or a catering oven or grill. In larger systems for industry, a given furnace, boiler house, reactor or the like may require many such burners 10, which will most conveniently be coupled to common air and fuel manifolds.

The burner 10 shown in the drawing burns remarkably quietly, thanks to the highly stable flame. By way of example, one such burner has an overall length of 275 mm and a diameter of 76 mm. The noise it generates is less than that produced by a fan supplying the air required for combustion.

What is claimed is:

1. A burner for combusting a gaseous mixture of gaseous fuel with a combustion supporting gas, such as oxygen or air, comprising a burner tube (11) open at one end (11') and closed at its other end (11") with a flame holder (30) at which fuel is burnt adjacent the open end (11'), the flame holder (30) being traversed by passageways (52, 54, 56, 58) for the gaseous mixture, the burner (10) having inlets (14, 16) adjacent the closed end (11") connected to combustion supporting gas and gaseous fuel supply lines, one of said lines having a control valve operable for controlling the size of the flame, the said one line having a pressure or flow transducer and the other line having a variable booster or restrictor responsive to the transducer, for balancing air and fuel supplied to the burner (10) to ensure the gaseous mixture remains stoichiometric irrespective of the size of the flame and such that the lowest gaseous fuel mixture flow rate is at least as low as $1/60^{th}$ the highest flow rate of the gaseous fuel mixture, each passageway (52, 54, 56, 58) having a flared exit (60) at the end nearer the open end (11') of the burner tube (11), each passageway being dimensioned such that at the highest obtainable flow rate of gaseous fuel mixture the flames do not lift off from the flame holder, and at the lowest flow rate the velocity of the gaseous fuel mixture at some point within the passageways (52, 54, 56, 58) is sufficient to prevent flame back through the flame holder.

2. A burner as claimed in claim 1 on which the inlets (14, 16) being furnished with metering nozzles (18, 20) for separately delivering air and fuel non-axially, e.g. substantially radially into the burner tube (11) which forms a mixing zone between the inlets (14, 16) and the flame holder (30), the metering nozzles (19, 20) having orifices (22, 24) with the flow cross-sectional areas correlating to the stoichiometric ratio of air-to-fuel for which the fuel is substantially completely burnt.

3. A burner according to claim 2, wherein the inlets (14, 16) are disposed in the burner tube (11) for delivering air and fuel in directions which impinge, to create turbulence and mixing inside the tube.

4. A burner according to claim 3, wherein the inlets (14, 16) are located diametrically opposite one another in the burner tube (11).

5. A burner according to any one of claims 1 or 2, wherein the ratio of the flow cross-sectional areas of orifices (22, 24) is 10 to 1.

6. A burner according to any one of claims 1 or 2, wherein the flame holder (30) provides a mounting for an igniter (32) and associated ground electrode (34).

7. A burner according to claim 6, wherein the flame holder (30) further provides a mounting for an ionization probe (40) for detecting unburnt carbon in the flame.

8. A burner according to claim 7, in combination with a monitor and control system coupled to the probe (40), in use for interrupting the fuel supply should the unburnt carbon exceed a predetermined level.

9. A burner according to claim 8, wherein the valve is in the air supply line and a booster or restricter is in the fuel line.

10. A burner according to claim 9, wherein the valve is in the fuel line and a variable speed fan is provided in the air line.

11. A burner as claimed in claim 1, comprising two or more radially nested tubes each pair of adjacent tubes defining therebetween one of said passageways of the flame holder (30) for the gaseous fuel.

12. A burner as claimed in claim 11, in which the tubes **(30*a*, 30*b*, 30*c*) are held in position relative to each other by one or more transverse pins (33)**.

13. A burner as claimed in claim 12, including a central bore with a flared exit.

14. A burner as claimed in any one of claims 11, 12 or 13 in which each flared exit has its terminal portion defined by inner and outer cylindrical walls which are parallel to the longitudinal axis of the flame holder.

* * * * *